US008587504B2

(12) United States Patent
Joo

(10) Patent No.: US 8,587,504 B2
(45) Date of Patent: Nov. 19, 2013

(54) LIQUID CRYSTAL DISPLAY AND METHOD OF DRIVING THE SAME

(75) Inventor: Soong Yong Joo, Seongnam-Si (KR)

(73) Assignee: Samsung Display Co., Ltd. (KR)

( * ) Notice: Subject to any disclaimer, the term of this patent is extended or adjusted under 35 U.S.C. 154(b) by 1224 days.

(21) Appl. No.: 11/931,904

(22) Filed: Oct. 31, 2007

(65) Prior Publication Data

US 2008/0278466 A1 Nov. 13, 2008

(30) Foreign Application Priority Data

May 11, 2007 (KR) ..... 10-2007-0045787

(51) Int. Cl.
*G09G 3/36* (2006.01)

(52) U.S. Cl.
USPC ..... 345/90; 345/87; 345/88; 345/204; 345/205; 345/690

(58) Field of Classification Search
USPC ..... 345/204, 87, 205
See application file for complete search history.

(56) References Cited

U.S. PATENT DOCUMENTS 6,097,362 A * 8/2000 Kim ..... 345/87
6,333,729 B1 * 12/2001 Ha ..... 345/98
6,919,681 B2 * 7/2005 Cok et al. ..... 313/500
6,954,191 B1 * 10/2005 Hirano et al. ..... 345/77
7,259,739 B2 * 8/2007 Yun et al. ..... 345/93
7,268,792 B2 * 9/2007 Lee et al. ..... 345/694
7,505,017 B1 * 3/2009 Yeo et al. ..... 345/88
7,557,791 B2 * 7/2009 Tokumura ..... 345/98
8,031,155 B2 * 10/2011 Jeoung et al. ..... 345/98
2005/0275610 A1 * 12/2005 Roh et al. ..... 345/88
2006/0017683 A1 * 1/2006 Murase et al. ..... 345/98
2006/0055656 A1 * 3/2006 Chung ..... 345/100
2007/0080914 A1 * 4/2007 Sun et al. ..... 345/88

* cited by examiner

*Primary Examiner* — Grant Sitta
(74) *Attorney, Agent, or Firm* — Cantor Colburn LLP

(57) ABSTRACT

A liquid crystal display ("LCD") includes an LCD panel, a data driving unit, and a selection unit. A configuration of the selection unit, which includes a plurality of switching devices driven by a selection control signal to connect a plurality of data lines to each channel of the data driving unit, is adjusted according to the selection control signal, so that charging voltages of the same color pixels of the LCD panel are made the same, whereby no stripe defect appears. In addition, the configuration of the selection unit is adjusted according to the selection control signal and the polarity change of the data signal supplied from the data driving unit, so that color aggregation caused by supplying the same polarity voltage to adjacent color pixels of the LCD panel can be minimized.

18 Claims, 5 Drawing Sheets

LIQUID CRYSTAL DISPLAY AND METHOD OF DRIVING THE SAME

This application claims priority to Korean Patent application No. 10-2007-0045787, filed on May 11, 2007 and all the benefits accruing therefrom under 35 U.S.C. 119, the contents of which are herein incorporated by reference in its entirety.

BACKGROUND OF THE INVENTION

1. Field of the Invention

The present invention relates to a liquid crystal display ("LCD") and a method of driving the same, and more particularly, to an LCD and a method of driving the same capable of improving display characteristics.

2. Description of the Related Art

In general, a liquid crystal display ("LCD") includes an LCD panel having a plurality of gate lines and a plurality of data lines, a gate driving circuit for supplying a gate driving signal to the plurality of gate lines, and a data driving circuit for supplying a data signal to the plurality of data lines. The LCD panel includes a lower substrate having pixel electrodes formed thereon, an upper substrate having a common electrode formed thereon, and a liquid crystal layer interposed therebetween. Voltage is applied between the electrodes to rearrange liquid crystal molecules in the liquid crystal layer and adjust transmissivity of light transmitted by the liquid crystal layer. The LCD panel is further formed with red R, green G, and blue B pixels, so that the pixels are driven by signals applied through the gate lines and the data lines to thereby display an image.

However, as the resolution of the LCD becomes higher, an aperture ratio of the LCD panel is reduced and thus luminance is degraded. To solve this problem, a PenTile pixel structure has been proposed. In the PenTile pixel structure, a blue unit pixel is shared to display two dots, and adjacent blue unit pixels receive a data signal from one data driving circuit and are driven by different gate driving circuits from each other. Furthermore, in order to further improve the luminance, an RGBW scheme has been proposed in which a white W pixel is provided in addition to red R, green G, and blue B pixels.

In recent years, a gate driving circuit is formed directly on an LCD panel to reduce a total size of the LCD and improve the productivity thereof. Thus, even when the resolution of the LCD panel increases, the number of stages constituting the gate driving circuit can be adjusted appropriately to deal with the increased resolution. However, a data driving circuit is mounted on the LCD panel in the form of a chip which is already made, so that it cannot properly deal with a change in the resolution of the LCD panel. In order to overcome this problem, a selection unit is provided between the data driving circuit and the LCD panel. The selection unit connects one channel of the data driving circuit and a plurality of data lines, and transfers a data signal supplied from the channel to the plurality of data lines at a time interval. Accordingly, pixels on a row selected by a gate driving signal supplied from the gate driving circuit are turned on, and the data signal from the data driving circuit is supplied to the four RGBW pixels sequentially via the selection unit at a time interval, whereby an image is displayed.

BRIEF SUMMARY OF THE INVENTION

The present invention provides a liquid crystal display ("LCD") and a method of driving the same which are capable of minimizing a display defect without reducing an aperture ratio.

The present invention provides an LCD and a method of driving the same which are capable of preventing stripe defect from appearing in a plurality of pixel arrays which receive a data signal from a same channel of a data driving circuit. The stripe defect herein is caused by a difference between charging voltages.

The present invention also provides an LCD and a method of driving the same which are capable of preventing appearance of color aggregation. The color aggregation herein is caused by applying data signal of a same polarity to a plurality of pixels adjacent to each other.

According to exemplary embodiments of the present invention, an LCD includes an LCD panel including a plurality of gate lines and a plurality of data lines arranged to cross each other, and a plurality of pixels respectively connected to the gate lines and the data lines, a data driving unit which generates a data signal and supplies the data signal via a plurality of channels, and a selection unit which connects one of the channels and a plurality of the data lines and prevents the data signal from an identical channel from being successively applied to adjacent data lines.

According to other exemplary embodiments of the present invention, an LCD includes an LCD panel including a plurality of gate lines and a plurality of data lines arranged to cross each other, and a plurality of pixels respectively connected to the gate lines and the data lines, a data driving unit which generates a data signal and supplies the data signal via a plurality of channels, and a selection unit which connects one of the channels and a plurality of the data lines, the selection unit preventing the data signal from a same channel from being successively applied to adjacent data lines and preventing the data signals of a same polarity from being applied to adjacent data lines within two neighboring channels.

According to further exemplary embodiments of the present invention, an LCD includes an LCD panel including a plurality of gate lines and a plurality of data lines arranged to cross each other, and a plurality of pixels respectively connected to the gate lines and the data lines, a signal control unit which processes pixel data and generates first and second control signals, a data driving unit which generates a data signal using the pixel data in response to the first control signal, changing a polarity of the data signal and supplying the data signal via a plurality of channels, and a selection unit which connects one of the channels and a plurality of the data lines and controls connection of the one of the channels and the data lines according to the second control signal and the polarity of the data signal.

The plurality of pixels may include red, green, blue and white pixels arranged sequentially in a direction of the gate lines, and same color pixels may not be arranged successively in the direction of the gate lines and a direction of the data lines.

The plurality of pixels may include red, green, blue and white pixels arranged sequentially in a direction of the gate lines, and two pixels may be alternatively arranged in a direction of the data lines.

The selection unit may sequentially apply the data signal to odd-numbered data lines and then to even-numbered data lines.

The selection unit may apply the data signal sequentially to the odd-numbered data lines and then sequentially to the even-numbered data lines for the plurality of data lines connected to odd-numbered channels, and apply the data signal in reverse order to the odd-numbered data lines and then in reverse order to the even-numbered data lines for the plurality of data lines connected to even-numbered channels.

The selection unit may include a plurality of switching devices driven by a plurality of selection signals.

The plurality of switching devices may be connected between the channels and the plurality of data lines so that the data signal is applied to the data lines at intervals of at least one data line for the plurality of data lines connected to an identical channel.

The plurality of selection signals may drive the plurality of switching devices so that the data signal is applied to the data lines at intervals of at least one data line for the plurality of data lines connected to an identical channel.

The plurality of switching devices may be connected between the channel and the plurality of data lines so that the data signal with different polarity is applied to the data lines at intervals of at least one data line for the plurality of data lines connected to an identical channel.

According to still further exemplary embodiments of the present invention, a method for driving an LCD includes generating a plurality of driving control signals according to an image signal and a display control signal, generating a data signal in response to a first driving control signal, to apply the data signal via a channel, and applying a gate on voltage to a gate line in response to a second driving control signal, and connecting the channel and a plurality of data lines, and controlling connection of the channel and the plurality of data lines so that the data signal is applied to the data lines at intervals of at least one data line in response to a third driving control signal and polarity of the data signal.

The data signal may be sequentially applied to odd-numbered data lines and then to even-numbered data lines.

The data signal may be applied sequentially to the odd-numbered data lines and then sequentially to the even-numbered data lines for the plurality of data lines connected to odd-numbered channels, and the data signal may be applied in reverse order to the odd-numbered data lines and then in reverse order to the even-numbered data lines for the plurality of data lines connected to even-numbered channels thereof.

BRIEF DESCRIPTION OF THE DRAWINGS

Exemplary embodiments of the present invention can be understood in more detail from the following description taken in conjunction with the accompanying drawings, in which.

DETAILED DESCRIPTION OF THE INVENTION

Figure 1:
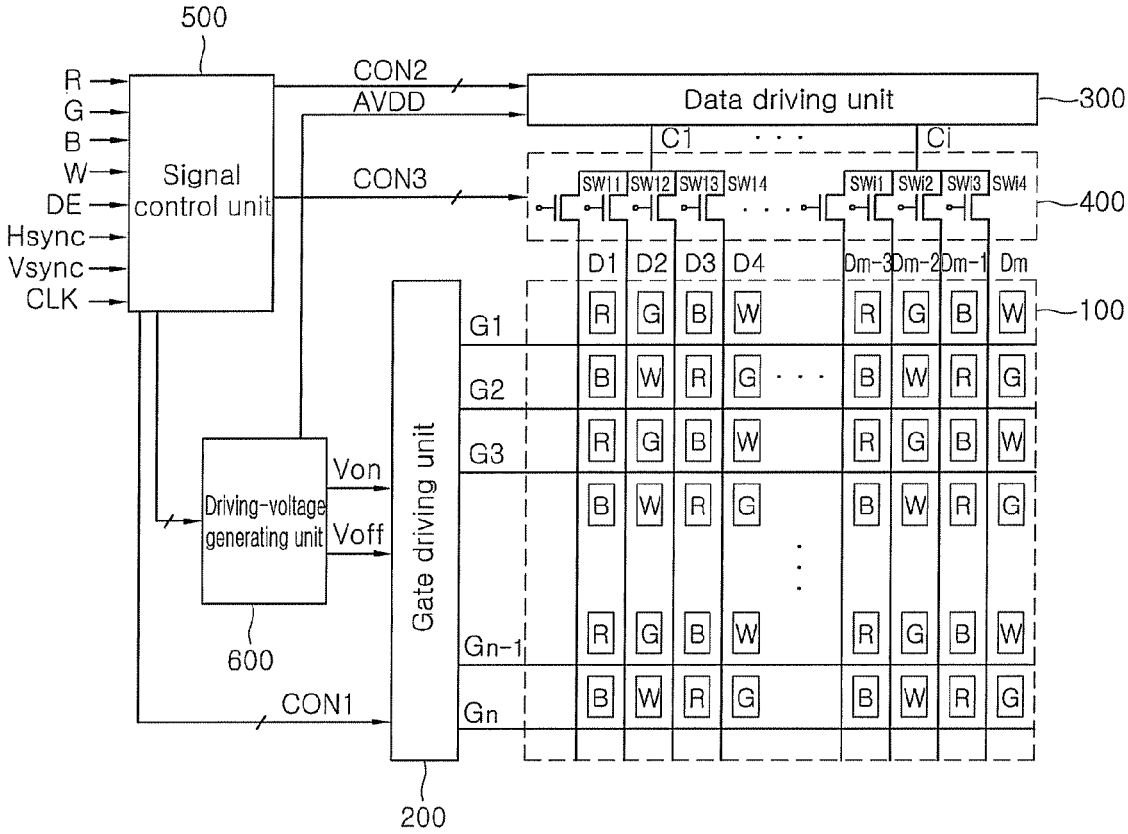
FIG. 1 is a block diagram of an exemplary embodiment of an LCD in accordance with the present invention.

Hereinafter, exemplary embodiments of the present invention will be described in detail with reference to the accompanying drawings. However, the present invention is not limited to the embodiments disclosed below but may be implemented into different forms. These embodiments are provided only for illustrative purposes and for full understanding of the scope of the present invention by those skilled in the art. Throughout the drawings, like reference numerals are used to designate like elements.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

While displaying an image on four RGBW pixels on a conventional liquid crystal display ("LCD") panel, a previously charged pixel is affected by a subsequently charged pixel and thus a stripe defect appears on the image due to the difference between the charging voltages. In other words, in a pixel structure where red R, green G, blue B and white W pixels are repeatedly arranged in a horizontal direction, when a data signal is supplied to the red R pixel and then subsequently to the green G pixel, the red R pixel stays in floating state due to a supplied gate driving signal. In other words, a charging voltage of the red R pixel increases under the influence of the data signal supplied to the green G pixel. Further, when a data signal is supplied to the blue B pixel, the charging voltage of the green G pixel increases under the influence of the data signal supplied to the blue B pixel. Similarly, when a data signal is supplied to the white W pixel, a charging voltage of the blue B pixel increases under the influence of the data signal supplied to the white W pixel. While a given pixel is charged and stays in a floating state, supplying a data signal to an adjacent pixel thereto causes an increase of the charging voltage of the given pixel under the influence of the data signal supplied to the adjacent pixel. Accordingly, in the pixel arrays that receive the data signal from the same channel through the selection unit, a charging voltage of the last pixel array is lower than that of the other pixel arrays, whereby a stripe defect appears in the last pixel array.

In order to overcome this problem, a capacity between the data line and the pixel or a capacity of a storage capacitor can be reduced. This, however, reduces the aperture ratio undesirably. The present invention is provided to minimize a display defect without reducing an aperture ratio.

Hereinafter, the present invention will be described with reference to the accompanying drawings.

Figure 2:
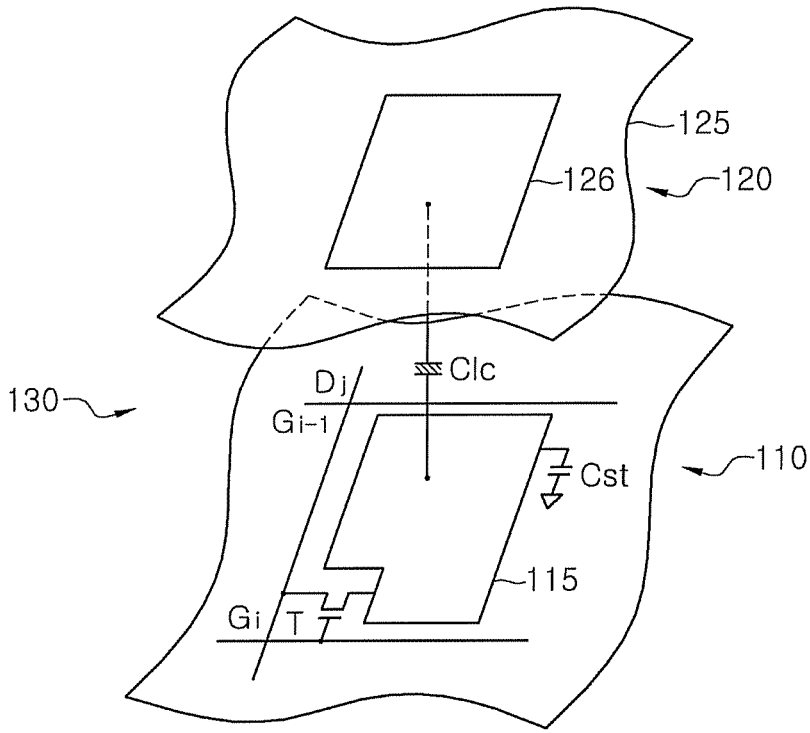
FIG. 2 is an equivalent circuit diagram of an exemplary embodiment of a pixel in accordance with the present invention.

FIG. 1 is a block diagram of an exemplary embodiment of a liquid crystal display ("LCD") in accordance with the present invention, and FIG. 2 is an equivalent circuit diagram of an exemplary pixel. In addition, FIG. 3 shows in detail an exemplary selection unit of an exemplary LCD in accordance with an exemplary embodiment of the present invention, and FIG. 4 is a waveform diagram of selection control signals.

Figure 3:
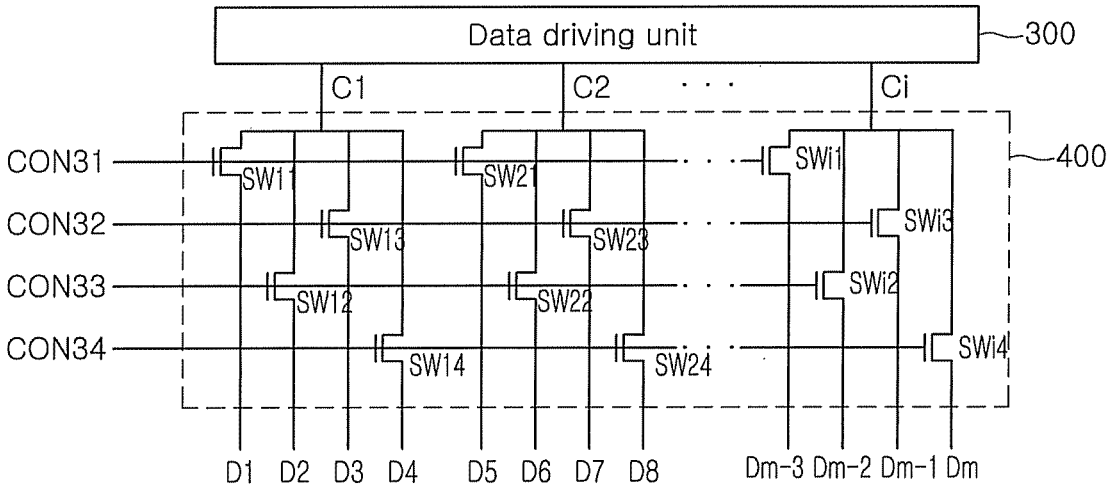
FIG. 3 is a schematic view showing an exemplary selection unit of an exemplary LCD in accordance with an embodiment of the present invention.
Figure 4:
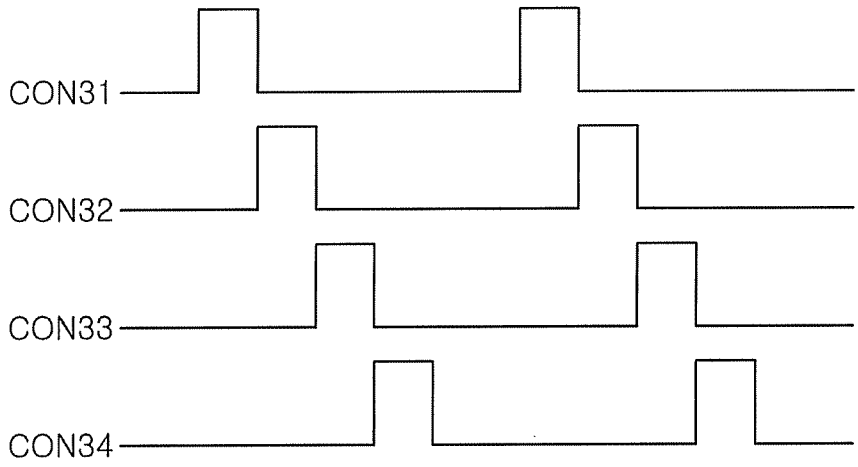
FIG. 4 is a waveform diagram of selection control signals for driving the exemplary selection unit in accordance with the embodiment of the present invention.

Referring to FIGS. 1 to 3, the LCD in accordance with the exemplary embodiment of the present invention includes an LCD panel 100 for displaying an image, which has thin film transistors ("TFTs") T respectively connected to a plurality of gate lines G1 to Gn and a plurality of data lines D1 to Dm arranged to cross each other, liquid crystal capacitors Clc and storage capacitors Cst, a gate driving unit 200 connected to the gate lines G1 to Gn for controlling the operation of the TFTs T, a data driving unit 300 for controlling a data signal applied to the liquid crystal capacitors Clc and the storage capacitors Cst via the TFTs T and outputting the data signal via the channels C1 to Ci, a selection unit 400 for selectively connecting the channels C1 to Ci and the plurality of data lines D1 to Dm, a signal control unit 500 for controlling the gate driving unit 200, the data driving unit 300 and the selection unit 400 using external control signals R, G, B, W, DE, Hsync, Vsync and CLK, and a driving-voltage generating unit 600 for generating driving voltages Von, Voff, and AVDD for the gate driving unit 200 and the data driving unit 300 in response to a signal from the signal control unit 500.

The LCD panel 100 includes the plurality of gate lines G1 to Gn extending in one direction and the plurality of data lines D1 to Dm extending in a direction perpendicular or substantially perpendicularly thereto. The LCD panel 100 further includes pixel areas that may be at intersections between the gate lines G1 to Gn and the data lines D1 to Dm. The pixel area is provided with a pixel including the TFT T, the storage capacitor Cst and the liquid crystal capacitor Clc. The pixel includes red R, green G, blue B and white W pixels. For example, the red R, green G, blue B and white W pixels are sequentially arranged in the odd-numbered rows of pixels, and the blue B, white W, red R and green G pixels are sequentially arranged in the even-numbered rows of pixels. Accordingly, the red R and blue B pixels appear alternately in each odd-numbered column of pixels, and the green G and white W pixels appear alternately in each even-numbered column of pixels. Alternatively, the pixels may be arranged in a variety of ways. For example, the red R, green G, blue B and white W pixels may be arranged so that the same color pixels do not appear successively in each direction.

In an exemplary embodiment, the LCD panel 100 may include a TFT substrate 110 having the TFTs T, the gate lines G1 to Gn, the data lines D1 to Dm and pixel electrodes 115 formed thereon, a common electrode substrate 120 having a black matrix, color filters 126, and a common electrode 125, and a liquid crystal layer 130 provided between the TFT substrate 110 and the common electrode substrate 120.

Here, each TFT T includes gate, source and drain terminals. The gate terminals, such as gate electrodes, are connected to the gate lines G1 to Gn, the source terminals, such as source electrodes, are connected to the data lines D1 to Dm, and the drain terminals, such as drain electrodes, are connected to the pixel electrodes 115. In response to a gate driving signal applied through a corresponding one of the gate lines G1 to Gn, the TFT T supplies a data signal, which is supplied through a corresponding one of the data lines D1 to Dm, to the pixel electrode 115 to change an electric field between both terminals of the liquid crystal capacitor Clc. This changes an arrangement of the liquid crystal molecules within the liquid crystal layer 130 in the LCD panel 100 to adjust transmissivity of light supplied from a backlight (not shown).

The pixel electrode 115 may have a number of groove and/or bump patterns as a domain control means for adjusting an arrangement direction of the liquid crystal layer 130. The common electrode 125 may also have a number of bump and/or groove patterns.

The gate driving unit 200, the data driving unit 300, the selection unit 400, the signal control unit 500 and the driving-voltage generating unit 600 are disposed outside the LCD panel 100 for providing a plurality of signals for driving the LCD panel 100. Here, the gate driving unit 200 may be formed on the LCD panel 100 simultaneously with the LCD panel 100. The data driving unit 300 may be mounted on the LCD panel 100. Alternatively, the data driving unit 300 may be mounted on a separate printed circuit board ("PCB") and then electrically connected to the LCD panel 100 via a flexible printed circuit ("FPC") board. The selection unit 400 may be mounted on the LCD panel 100, and the signal control unit 500 and the driving-voltage generating unit 600 may be mounted on a PCB and electrically connected to the LCD panel 100 via an FPC board.

The signal control unit 500 receives image signals, i.e., pixel data R, G, B and W, and control signals, such as a horizontal synchronization signal Hsync, a vertical synchronization signal Vsync, a main clock CLK, a data enable signal DE and the like from an external graphic controller (not shown). The signal control unit 500 processes the pixel data R, G, B and W according to an operation condition of the LCD panel 100 to generate a gate control signal CON1, a data control signal CON2 and a selection control signal CON3, and sends the signals to the gate driving unit 200, the data driving unit 300 and the selection unit 400, respectively. Here, the gate control signal CON1 includes a vertical synchronization start signal for instructing to output the gate turn-on voltage Von, a gate clock signal for controlling a time when the gate turn-on voltage Von is output, an output enable signal for controlling the duration of the gate turn-on voltage Von, and the like. Further, the data control signal CON2 includes a horizontal synchronization start signal for indicating a transmission start of the pixel data, a load signal for instructing to apply a data voltage to the corresponding data line, an inversion signal for inverting the polarity of a gradation voltage relative to a common voltage, a data clock signal, and the like. The selection control signal CON3 includes a plurality of selection control signals CON31 to CON34 for sequentially controlling a plurality of switching devices SW11 to SWi4 of the selection unit 400, as will be further described below.

The driving-voltage generating unit 600 generates a variety of driving voltages using external power input from an external power supply. The driving-voltage generating unit 600 generates a reference voltage AVDD, the gate turn-on voltage Von, a gate turn-off voltage Voff and the common voltage. In response to a control signal from the signal control unit 500, the driving-voltage generating unit 600 applies the gate turn-on voltage Von and the gate turn-off voltage Voff to the gate driving unit 300 and applies the reference voltage AVDD to the data driving unit 300. Here, the reference voltage AVDD is used as a reference voltage for generating the gradation voltage to drive the liquid crystal in the liquid crystal layer 130.

The gate driving unit 200 applies the gate turn on/off voltage Von/Voff from the driving-voltage generating unit 600 to the gate lines G1 to Gn in response to the gate control signal CON1 from the signal control unit 500. Accordingly, the TFTs T can be controlled so that the gradation voltage is applied to the pixels.

The data driving unit 300 generates the gradation voltage using the data control signal CON2 from the signal control unit 500 and the reference voltage AVDD from the driving-voltage generating unit 600, and then applies the gradation voltage to the channels C1 to Ci. That is, the data driving unit 300 converts the input digital pixel data based on the reference voltage AVDD to generate an analog data signal, i.e., the gradation voltage.

The selection unit 400 is provided on the LCD panel 100 to connect the channels C1 to Ci of the data driving unit 300 to the plurality of data lines D1 to Dm. To this end, the selection unit 400 includes the plurality of switching devices SW11 to SWi4 sequentially driven by the selection control signal CON3 from the signal control unit 500, to sequentially supply the data signal from the data driving unit 300 to the plurality of data lines D1 to Dm via the channels C1 to Ci. For example, four switching devices SW11 to SW14 are used to connect one channel C1 to four data lines D1 to D4. Here, each of the plurality of switching devices SW11 to SWi4 may include a transistor. The switching device may be any device for connecting one of the channels C1 to Ci and the plurality of data lines D1 to Dm in response to the selection control signal CON3. In one exemplary embodiment, when the four switching devices SW11 to SWi4 are used to connect one of the channels C1 to Ci and four of the data lines D1 to Dm, the first switching devices SW11 to SWi1 are driven by the first selection control signal CON31, the second switching devices SW12 to SWi2 are driven by the third selection control signal CON33, the third switching devices SW13 to SWi3 are driven by the second selection control signal CON32, and the fourth switching devices SW14 to SWi4 are driven by the fourth selection control signal CON34 according to a connection order. The selection control signal CON3 is input in the form of a pulse in order of the first selection control signal CON31, the second selection control signal CON32, the third selection control signal CON33, and the fourth selection control signal CON34, as shown in FIG. 4. Accordingly, the first switching devices SW11 to SWi1, the third switching devices SW13 to SWi3, the second switching devices SW12 to SWi2, and the fourth switching devices SW14 to SWi4 are driven in this order.

An exemplary method for driving the exemplary LCD in accordance with an embodiment of the present invention will be described in more detail.

As shown in FIG. 1, on the LCD panel 100, the red R, green G, blue B and white W pixels are sequentially arranged in the odd-numbered rows, e.g. rows of pixels connected to gate lines G1, G3, . . . , and the blue B, white W, red R and green G pixels are sequentially arranged in the even-numbered rows, e.g. rows of pixels connected to gate lines G2, G4, . . . . Accordingly, the red R and blue B pixels appear alternately in each odd-numbered column, e.g. columns of pixels connected to data lines D1, D3, . . . , and the green G and white W pixels appear alternately in each even-numbered column, e.g. columns of pixels connected to data lines D2, D4, . . . .

The signal control unit 500 receives the image signals R, G, B and W and the control signals, such as the vertical synchronization signal Vsync, the horizontal synchronization signal Hsync, the main clock CLK and the data enable signal DE from the external graphic controller (not shown). The signal control unit 500 generates the gate control signal CON1, the data control signal CON2 and the selection control signal CON3 using the image signals R, G, B and W and the control signals, and properly processes the image signals R, G, B and W according to the operation condition of the LCD panel 100. The generated gate control signal CON1 is input to the gate driving unit 200, the data control signal CON2 and the processed image signals are input to the data driving unit 300, and the selection control signal CON3 is input to the selection unit 400. Here, the selection control signal CON3 includes the first to fourth selection control signals CON31 to CON34 for controlling an on/off timing of the plurality of switching devices SW11 to SWi4 of the selection unit 400. The first selection control signal CON31, the second selection control signal CON32, the third selection control signal CON33 and the fourth selection control signal CON34 are output in the form of a pulse in this order, as shown in FIG. 4.

In response to the data control signal CON2, the data driving unit 300 sequentially receives image data corresponding to pixels on one row, selects a gradation voltage corresponding to each image data to convert the image data into a data signal, and sequentially supplies the data signal via the channels C1 to Ci.

In response to the gate control signal CON1, the gate driving unit 200 applies the gate on voltage Von to the gate lines G1 to Gn and thus turns on the TFTs T connected to the gate lines G1 to Gn.

When the gate on voltage Von is applied to the gate line G1, so that the TFTs T connected to the gate line G1 are turned on, and the data signal is applied via the channel C1, the first to fourth selection control signals CON31 to CON34 are sequentially applied to drive the four switching devices SW11, SW13, SW12, and SW14 in this order. Thus, the data signal is applied in sequence to the red R, blue B, green G and white W pixels that are connected to the data lines D1, D3, D2 and D4 respectively. Accordingly, while the blue B pixel is being charged, the charging voltage of the red R pixel does not increase because it is spaced apart from the blue B pixel. In addition, the charging voltage of the green G pixel does not increase because it is not being charged. Further, the charging voltage of the red R pixel increases when the green G pixel is being charged, and the charging voltage of the blue pixel B increases when the white W pixel is being charged. After one horizontal period (i.e., one period of the horizontal synchronization signal Hsync, the data enable signal DE and the gate clock) elapses in this manner, the data driving unit 300 and the gate driving unit 200 repeatedly perform the same operation on the pixels of the next row. If the pixel arrays connected to the data lines D1 to Dm are charged, the charging voltage of the first and third pixel arrays, out of the pixel arrays receiving the data signal from one of the channels C1 to Ci, increases, and the charging voltage of the second and fourth pixel arrays remains unchanged. Accordingly, when the voltage of the data lines D1 to Dm is changed, only the charging voltage of the same color pixel array is changed. That is, the charging voltage of the pixel arrays including the red R and blue B pixels increases, and the charging voltage of the pixel arrays including green G and white W pixels remains unchanged. Accordingly, since charging voltage in the same color pixel arrays is made the same, the stripe defect does not appear on the pixels. This is because the stripe defect appears when the charging voltage in the same color pixel arrays differs.

In the LCD in accordance with the exemplary embodiment of the present invention described with respect to FIG. 3, the connection of the switching devices SW11 to SWi4 of the selection unit 400, which are driven by the first to fourth selection control signals CON31 to CON34 sequentially applied, is adjusted, so that the change in the charging voltage occurs only at the array of the same color pixels, whereby no stripe defect appears. However, in an alternative exemplary embodiment, the same result can be obtained by changing the order of applying the first to fourth selection control signals CON31 to CON34 instead of adjusting the connection of the switching devices SW11 to SWi4. This will be described as follows.

Figure 5:
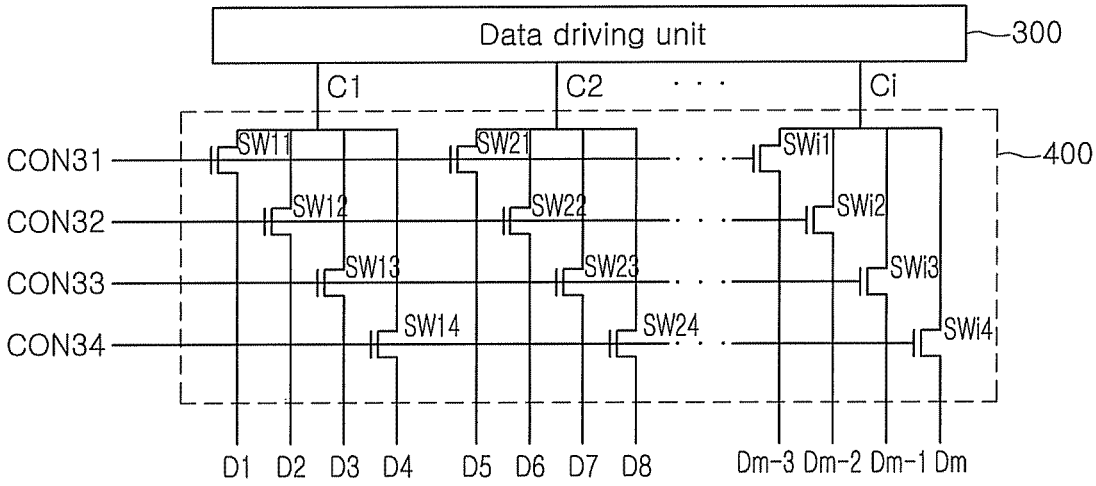
FIG. 5 is a schematic view showing an exemplary selection unit of an exemplary LCD in accordance with another embodiment of the present invention.
Figure 6:
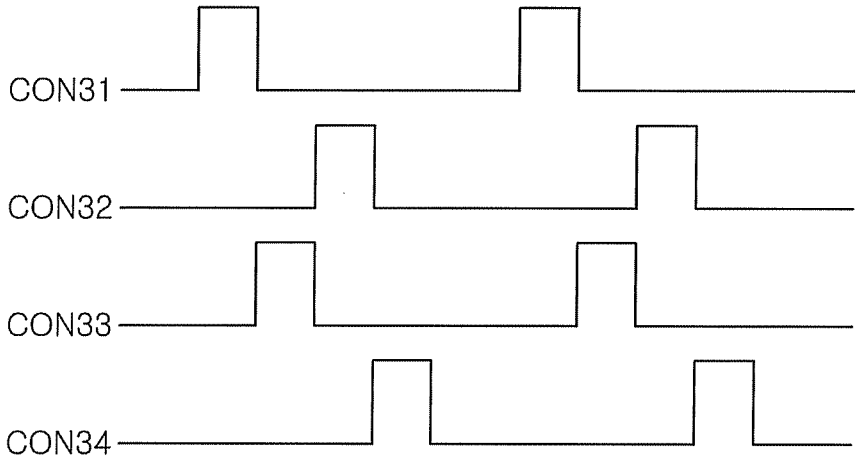
FIG. 6 is a waveform diagram of selection control signals for driving the exemplary selection unit in accordance with another embodiment of the present invention.

FIG. 5 is a schematic view showing an exemplary selection unit of an exemplary LCD in accordance with another exemplary embodiment of the present invention, and FIG. 6 is a waveform diagram of selection control signals.

Referring to FIGS. 1 and 5, a selection unit 400 includes a plurality of switching devices SW11 to SWi4 driven by a selection control signal CON3 output from a signal control unit 500. For example, four switching devices SW11 to SW14 are used to connect one channel C1 to four data lines D1 to D4. Here, each of the plurality of switching devices SW11 to SWi4 may include a transistor. The switching device may be any device for connecting one of each of the channels C1 to Ci and the plurality of data lines D1 to Dm in response to the selection control signal CON3. When four of the switching devices SW11 to SWi4 are used to connect one of the channels C1 to Ci and a corresponding four of the data lines D1 to Dm, the first switching devices SW11 to SWi1 are driven by a first selection control signal CON31, the second switching devices SW12 to SWi2 are driven by a second selection control signal CON32, the third switching devices SW13 to SWi3 are driven by a third selection control signal CON33, and the fourth switching devices SW14 to SWi4 are driven by a fourth selection control signal CON34 according to a connection order. The selection control signal CON3 is input in the form of a pulse in order of the first selection control signal CON31, the third selection control signal CON33, the second selection control signal CON32, and then the fourth selection control signal CON34, as shown in FIG. 6. Accordingly, the first switching devices SW11 to SWi1, the third switching devices SW13 to SWi3, the second switching devices SW12 to SWi2 and the fourth switching devices SW14 to SWi4 are turned on in this order. For example, when a gate on voltage Von is applied to the gate line G1, the TFTs T connected to the gate line G1 are turned on. Then, when the data signal is applied via the channel C1, the switching device SW11, the switching device SW13, the switching device SW12 and the switching device SW14 are driven in this order. Accordingly, the data signal is applied to the red R, blue B, green G and white W pixels connected to the data lines D1, D3, D2 and D4 in this order. Accordingly, while the blue B pixel is being charged, the charging voltage of the red R pixel does not increase because it is spaced apart from the blue B pixel. In addition, the charging voltage of the green G pixel does not increase either, because it is not being charged. Further, the charging voltage of the red R pixel increases when the green G pixel is being charged, and the charging voltage of the blue B pixel increases when the white W pixel is being charged. When the pixels connected to the data lines D1 to Dm are charged in this manner, the charging voltage of the first and third pixel arrays increase, and the charging voltage of the second and fourth pixel arrays remain unchanged. Accordingly, when the voltage of the data lines D1 to Dm is changed, only the charging voltage of the same color pixel array is changed, whereby no stripe appears.

Figure 7:
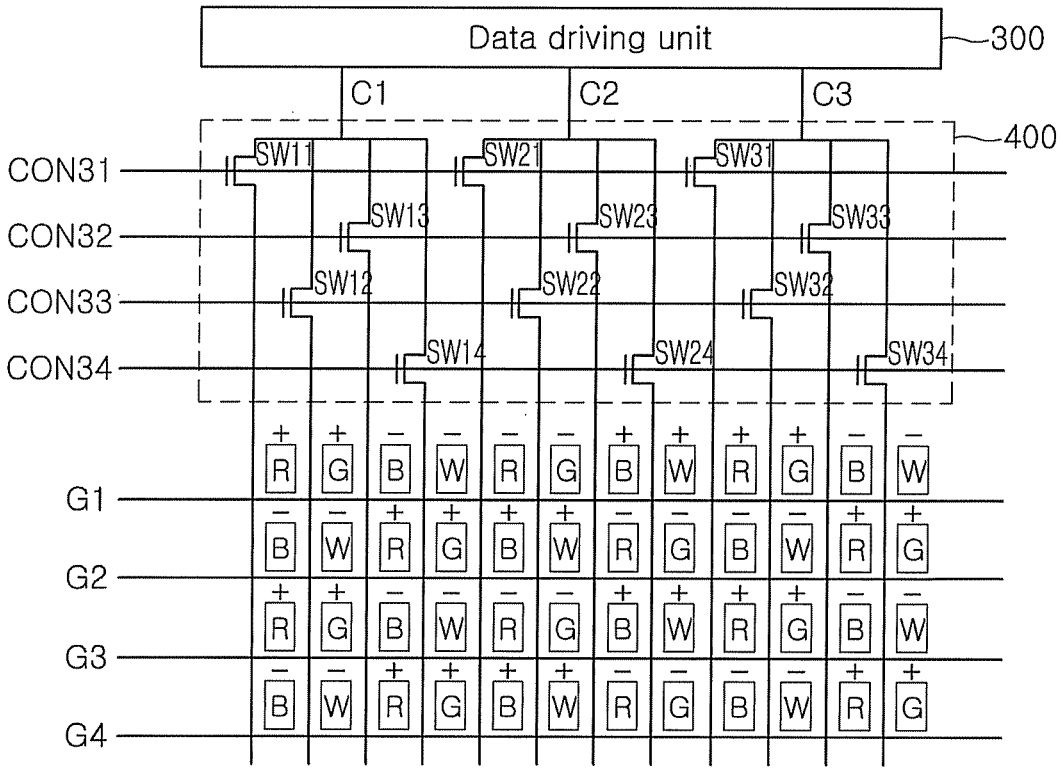
FIG. 7 is a view illustrating polarities of pixels in frame inversion operation in accordance with an exemplary embodiment of the present invention.

In the aforementioned exemplary embodiments, the LCD can be driven by applying a data signal having one polarity to the pixels connected to one gate line, and then applying a data signal having a changed polarity to the pixels connected to the next gate line. However, in the dot or column inversion operation, a data signal having different polarities is applied even to the pixels connected to one gate line, whereby four or more pixels having the same polarity may be arranged successively when the selection unit has the configuration shown in FIG. 3. For example, when a data signal of (+), (−), (+) and (−) polarities is applied from the channel C1 to the red R, green G, blue B and white W pixels repeatedly connected to the gate line G1, a data signal of (−), (+), (−) and (+) polarities is applied from the channel C2, and a data signal of (+), (−), (+) and (−) polarities is applied from the channel C3, a data signal of (+), (+), (−), (−), (−), (−), (+), (+), (+), (+), (−) and (−) polarities is applied to the pixels repeatedly connected to the gate line G1 as shown in FIG. 7, and other odd-numbered gate lines. In this manner, a data signal of (−), (−), (+), (+), (+), (+), (−), (−), (−), (−), (+) and (+) polarities is applied to the pixels connected to the gate line G2, and other even-numbered gate lines. When the data signal of the same polarity is continuously applied to the pixels, which share the gate line in this manner, color aggregation appears.

Accordingly, in the case of the dot or column inversion operation, it is desirable that the configuration of the selection unit is changed. Such an embodiment will be described with reference to FIG. 8.

Figure 8:
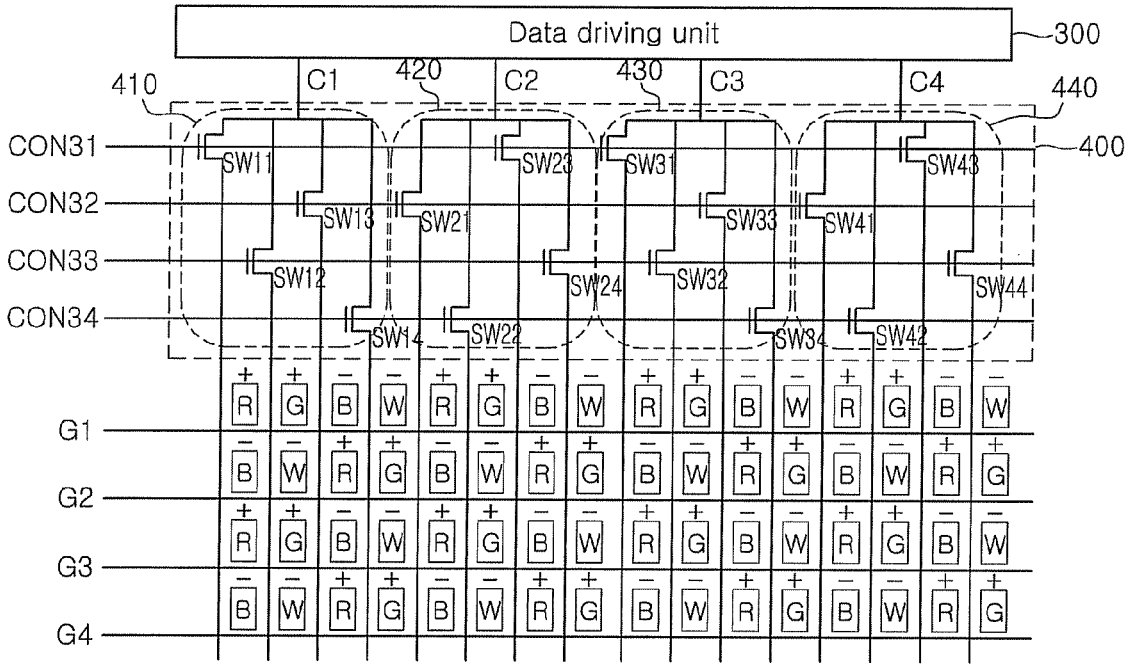
FIG. 8 is a view illustrating an exemplary selection unit of an exemplary LCD and polarities of pixels during dot or column inversion operation in accordance with a further exemplary embodiment of the present invention.
Figure 9:
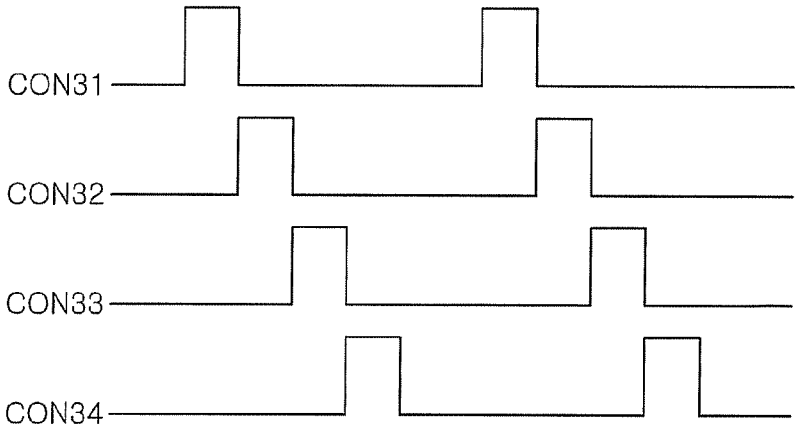
FIG. 9 is a waveform diagram of selection control signals for driving the exemplary selection unit in accordance with the further exemplary embodiment of the present invention.

FIG. 8 illustrates a configuration of an exemplary selection unit of an exemplary LCD using dot or column inversion in accordance with a further embodiment of the present invention, and FIG. 9 is a waveform diagram of selection control signals for driving the exemplary selection unit of FIG. 8.

Referring to FIGS. 1 and 8, a selection unit 400 includes a plurality of switching device blocks 410 to 440 driven by a selection control signal CON3. Each of the switching device blocks 410 to 440 includes a plurality of switching devices SW11 to SWi4 for connecting one of the channels C1 to Ci and a plurality of data lines D1 to Dm For example, the switching device block 410 includes four switching devices SW11 to SW14. Here, each of the switching devices SW11 to SWi4 includes a device, such as a transistor, capable of controlling connection of the channels C1 to Ci and the data lines D1 to Dm in response to the selection control signal CON3. The switching devices SW11 to SWi4 are configured to be different from each other depending on the switching device block 410 to 440. That is, among the switching devices of the odd-numbered switching device blocks 410 and 430, the first switching devices SW11 and SW31 are driven by a first selection control signal CON31, the second switching devices SW12 and SW32 are driven by a third selection control signal CON33, the third switching devices SW13 and SW33 are driven by a second selection control signal CON32, and the fourth switching devices SW14 and SW34 are driven by a fourth selection control signal CON34. In addition, among the switching devices of the even-numbered switching device blocks 420 and 440, the first switching devices SW21 and SW41 are driven by the second selection control signal CON32, the second switching devices SW22 and SW42 are driven by the fourth selection control signal CON34, the third switching devices SW23 and SW43 are driven by the first selection control signal CON31, and the fourth switching devices SW24 and SW44 are driven by the third selection control signal CON33. The selection control signal CON3 is input in the form of a pulse in order of the first selection control signal CON31, the second selection control signal CON32, the third selection control signal CON33 and the fourth selection control signal CON34, as shown in FIG. 9. Accordingly, in the odd-numbered switching device blocks 410 and 430, the first switching devices SW11 to SW31, the third switching devices SW13 to SW33, the second switching devices SW12 to SW32 and the fourth switching devices SW14 to SW34 are turned on in this order; and in the even-numbered switching device blocks 420 and 440, the third switching devices SW23 to SW43, the first switching devices SW21 to SW41, the fourth switching devices SW24 to SW44 and the second switching devices SW22 to SW42 are turned on in this order.

When a data voltage is applied through the dot or column inversion using the selection unit 400 having the aforementioned configuration, e.g., when a data signal of (+), (−), (+) and (−) polarities is applied from the channel C1 to red R, green G, blue B and white W pixels repeatedly connected to the gate line G1, a data signal of (−), (+), (−) and (+) polarities is applied from the channel C2, a data signal of (+), (−), (+) and (−) polarities is applied from the channel C3, and a data signal of (−), (+), (−) and (+) polarities is applied from the channels C4, a data signal of (+), (+), (−), (−), (+), (+), (−), (−), (+), (+), (−), (−), (+), (+), (−) and (−) polarities is applied to the pixels repeatedly connected to the gate line G1, and to the other odd-numbered gate lines. Similarly, a data signal of (−), (−), (+), (+), (−), (−), (+), (+), (−), (−), (+), (+), (−), (−), (+) and (+) polarities is applied to the pixels connected to the gate line G2, and to the other even-numbered gate lines. By doing so, the data voltage of the same polarity is not successively applied to the pixels that share a gate line, whereby no color aggregation appears.

In the aforementioned embodiments, the selection unit 400 connects one channel and four data lines using four switching devices, however the present invention is not limited thereto. That is, the selection unit 400 may alternatively, for example, connect one channel and eight data lines using eight switching devices. In such a case, the selection control signal CON3 requires eight pulse signals that are sequentially applied. An order of connecting the switching devices and an order of applying the pulse may be changed so that a data signal with the same polarity is not applied to successive pixels. In a configuration where one channel and eight data lines are connected through eight switching devices and line inversion is used, the switching devices may be turned on in an order of the first, the third, the fifth, the seventh, the second, the fourth, the sixth and then the eighth switching device. Further, when one channel and eight data lines are connected through eight switching devices and the dot or column inversion is used, the switching devices connected to the odd-numbered channels may be turned on in an order of the first, the third, the fifth, the seventh, the second, the fourth, the sixth and then the eighth switching device. In addition, the switching devices connected to the even-numbered numbered channels may be turned on in an order of the third, the first, the seventh, the fifth, the fourth, the second, the eighth and then the sixth switching device.

As described above, according to exemplary embodiments of the present invention, the configuration of the selection unit, which includes a plurality of switching devices driven by the selection control signal to connect a plurality of data lines to each channel of the data driving unit, is adjusted according to the selection control signal, so that the charging voltages of the same color pixels of the LCD panel are made the same, whereby no stripe defect appears.

In addition, according to exemplary embodiments of the present invention, the configuration of the selection unit is adjusted according to the selection control signal and the change in the polarity of the data signal supplied from the data driving unit, so that color aggregation, which is caused by supplying the same polarity voltage to adjacent color pixels of the LCD panel, does not appear.

Thus, the display quality of the LCD can be improved without reducing the aperture ratio.

While the present invention has been illustrated and described in connection with the accompanying drawings and the exemplary embodiments, the present invention is not limited thereto and is defined by the appended claims. Therefore, it will be understood by those skilled in the art that various modifications and changes can be made thereto without departing from the spirit and scope of the invention defined by the appended claims.

What is claimed is:

1. A liquid crystal display, comprising:

a liquid crystal display panel including a plurality of gate lines and a plurality of data lines arranged to cross each other, and a plurality of pixels respectively connected to the plurality of gate lines and the plurality of data lines;

a data driving unit which generates a plurality of data signals and supplies the plurality of data signals via a plurality of channels; and a selection unit which connects one of the plurality of channels and data lines of the plurality of data lines, and prevents one of the plurality of data signals from the one of the plurality of channels from being successively applied to adjacent data lines of the plurality of data lines, wherein the one of the plurality of channels comprises only different color pixels;

wherein two different color pixels are alternatively arranged in a direction of the plurality of data lines for at least one data line of the plurality of data lines, and wherein the selection unit sequentially applies the one of the plurality of data signals to odd-numbered data lines and then to even-numbered data lines.

2. The display as claimed in claim 1, wherein the plurality of pixels comprise red, green, blue and white pixels arranged sequentially in a direction of the plurality of gate lines, and same color pixels are not arranged successively in the direction of the plurality of gate lines and a direction of the plurality of data lines.

3. The display as claimed in claim 1, wherein the plurality of pixels comprises red, green, blue and white pixels arranged sequentially in a direction of the plurality of gate lines.

4. The display as claimed in claim 1, wherein the selection unit comprises a plurality of switching devices driven by a plurality of selection signals.

5. The display as claimed in claim 4, wherein the plurality of switching devices are connected between the one of the plurality of channels and one of the plurality of data lines so that the data signal is applied to every Nth data lines, wherein N is an integer 2 or more, for the plurality of data lines connected to the one of the plurality of channels.

6. The display as claimed in claim 4, wherein the plurality of selection signals drive the plurality of switching devices so that the data signal is applied to every Nth data line, wherein N is an integer 2 or more, for the plurality of data lines connected to the one of the plurality of channels.

7. The display as claimed in claim 4, wherein the plurality of switching devices are connected between the one of the plurality of channels and one of the plurality of data lines so that the data signal with different polarity is applied to every Nth data line, wherein N is an integer 2 or more, for the plurality of data lines connected to the one of the plurality of channels.

8. A liquid crystal display, comprising:

a liquid crystal display panel including a plurality of gate lines and a plurality of data lines arranged to cross each other, and a plurality of pixels respectively connected to the plurality of gate lines and the plurality of data lines;

a data driving unit which generates a plurality of data signals and supplies the plurality of data signal via a plurality of channels; and a selection unit which connects one of the plurality of channels and one of the plurality of data lines, prevents one of the plurality of data signals from the one of the plurality of channels from being successively applied to adjacent data lines, and prevents one of the plurality of data signals of a same polarity from being applied to adjacent data lines of the plurality of data lines within two neighboring channels of the plurality of channels, wherein the one of the plurality of channels comprises only different color pixels;

wherein two different color pixels are alternatively arranged in a direction of the plurality of data lines for at least one data line of the plurality of data lines, and wherein the selection unit applies the one of the plurality of data signals sequentially to odd-numbered data lines and then sequentially to even-numbered data lines for the plurality of data lines connected to odd-numbered channels.

9. The display as claimed in claim 8, wherein the plurality of pixels comprise red, green, blue and white pixels arranged sequentially in a direction of the plurality of gate lines, and same color pixels are not arranged successively in the direction of the gate lines and a direction of the plurality of data lines.

10. The display as claimed in claim 8, wherein the plurality of pixels comprises red, green, blue and white pixels arranged sequentially in a direction of the plurality of gate lines.

11. The display as claimed in claim 8, wherein the selection unit applies the one of the plurality of data signals in reverse order to the odd-numbered data lines and then in reverse order to the even-numbered data lines for the plurality of data lines connected to even-numbered channels.

12. The display as claimed in claim 8, wherein the selection unit comprises a plurality of switching devices driven by a plurality of selection signals.

13. The display as claimed in claim 12, wherein the plurality of switching devices are connected between the channels and the plurality of data lines so that the data signal is applied to every Nth data line, wherein N is an integer 2 or more, for the plurality of data lines connected to an identical channel.

14. The display as claimed in claim 12, wherein the plurality of selection signals drive the plurality of switching devices so that the data signal is applied to every Nth data line, wherein N is an integer of 2 or more, for the plurality of data lines connected to an identical channel.

15. The display as claimed in claim 12, wherein the plurality of switching devices are connected between the channel and the plurality of data lines so that the data signal with different polarity is applied to every Nth data line, wherein N is an integer 2 or more, for the plurality of data lines connected to an identical channel.

16. A liquid crystal display, comprising:

a liquid crystal display panel including a plurality of gate lines and a plurality of data lines arranged to cross each other, and a plurality of pixels respectively connected to the plurality of gate lines and the plurality of data lines;

a signal control unit which processes pixel data and generates first and second control signals;

a data driving unit which generates a plurality of data signals using the pixel data in response to the first control signal, changes a polarity of data signals of the plurality of data signals and supplies the data signals of the plurality of data signals via a plurality of channels; and a selection unit which connects one of the plurality of channels and data lines of the plurality of data lines and controls connection of the one of the plurality of channels and the data lines of the plurality of data lines according to the second control signal and the polarity of the data signal, wherein the one of the plurality of channels comprises only different color pixels;

wherein two different color pixels are alternatively arranged in a direction of the plurality of data lines for at least one data line of the plurality of data lines, and wherein the selection unit applies the one of the plurality of data signals sequentially to odd-numbered data lines and then sequentially to even-numbered data lines for the plurality of data lines connected to odd-numbered channels.

17. A method for driving a liquid crystal display, the method comprising:

generating a plurality of driving control signals according to an image signal and a display control signal;

generating a plurality of data signals from a data driving unit in response to a first driving control signal to apply the data signal via a plurality of channels, and applying a gate on voltage to a gate line in response to a second driving control signal; and connecting one the plurality of channels and data lines of a plurality of data lines, and controlling connection of one of the plurality of channels and the data lines of the plurality of data lines so that one of the plurality of data signals is applied to the data lines of the plurality of data lines at intervals of at least one data line in response to a third driving control signal and polarity of the one of the plurality of data signal, wherein the one of the plurality of channels comprises only different color pixels;

wherein two different color pixels are alternatively arranged in a direction of the plurality of data lines for at least one data line of the plurality of data lines, and wherein the one of the plurality of data signals is sequentially applied to odd-numbered data lines and then to even-numbered data lines.

18. The method as claimed in claim 17, wherein the one of the data signal is applied sequentially to the odd-numbered data lines and then sequentially to the even-numbered data lines for the data lines of the plurality of data lines connected to odd-numbered channels; and the data signal is applied in reverse order to the odd-numbered data lines and then in reverse order to the even-numbered data lines for the data lines of the plurality of data lines connected to even-numbered channels.

* * * * *